US006433808B1

(12) United States Patent
Kershner et al.

(10) Patent No.: US 6,433,808 B1
(45) Date of Patent: Aug. 13, 2002

(54) METHOD AND APPARATUS FOR PRINTING AND DISPENSING LINER-LESS MEDIA WITH ADHESIVE BACKING

(75) Inventors: Paul Kershner; Pixie A. Austin; Howard H. Nojiri, all of Snohomish City, WA (US); Bjorn Henriksson; Anders Akesson, both of Gothenburg (SE)

(73) Assignee: Intermec Technologies Corporation, Everett, WA (US)

( * ) Notice: Subject to any disclaimer, the term of this patent is extended or adjusted under 35 U.S.C. 154(b) by 0 days.

(21) Appl. No.: 09/658,533

(22) Filed: Sep. 9, 2000

Related U.S. Application Data

(63) Continuation-in-part of application No. 09/250,827, filed on Feb. 17, 1999, now Pat. No. 6,151,055, which is a continuation-in-part of application No. 08/722,745, filed on Oct. 1, 1996, now abandoned.

(51) Int. Cl.[7] ..... B41J 29/00
(52) U.S. Cl. ..... 347/215

(58) Field of Search ..... 347/215

(56) References Cited

U.S. PATENT DOCUMENTS 5,375,752 A * 12/1994 Michalovic ..... 225/2
5,560,293 A * 10/1996 Boreali et al. ..... 101/288
5,674,345 A * 10/1997 Nash ..... 156/264
6,129,810 A * 10/2000 Schweitzer et al. ..... 156/387
6,145,423 A * 11/2000 Boreali et al. ..... 83/145
6,151,055 A * 11/2000 Ackley et al. ..... 347/215

* cited by examiner

*Primary Examiner*—Huan Tran
(74) *Attorney, Agent, or Firm*—Orum & Roth

(57) ABSTRACT

A printer capable of operation with linered and/or liner-less media. Powder coated media surfaces, a silicone platen roller and tear-off blade are either designed into the media path or retrofitted into a linered media capable printer. To remove the requirement for realignment between the media path extrusion and the print head a media path extrusion cover designed to snap on to the media path extrusion is utilized.

4 Claims, 2 Drawing Sheets

METHOD AND APPARATUS FOR PRINTING AND DISPENSING LINER-LESS MEDIA WITH ADHESIVE BACKING

RELATED APPLICATION

This application is a Continuation-In-Part of application Ser. No. 09/250,827 filed Feb. 17, 1999 now U.S. Pat. No. 6,151,055, which is a Continuation-In-Part of application Ser. No. 08/722,745 filed Oct. 1, 1996 abandoned.

BACKGROUND OF THE INVENTION

The present invention relates to thermal printing, and more particularly, to a thermal printer that can Operate with both conventional liner and liner-less print media. A conversion kit allows an originally only conventional liner capable printer to become a liner or liner-less media capable printer.

Formerly, liner-less label capable printers utilized a non-stick surface applied by a process known as plasma coating. Plasma coating however, is inherently more costly and limited to substrates that can withstand the heat of contact with vaporized metal particles. Plasma coating upon cutting surfaces dulls the cutting surface through the deposition of a rounded edge surface upon the original cutting edge. The use of plasma coating on printer components also limits the choice of colors which can be used. Color selection of interior and exterior visible portions of the printer contributes to the overall appearance and integration of the non-stick component with the rest of the components in the printer. Plastic materials used to create non-stick surfaces have limited durability and strength when used in applications where there is repeated relative motion between a printing mechanism and the media it is designed to transport. Tests of existing plasma coating liner-less label printers using linered label stock, reveal that plasma coatings are two slippery for linered label stock to dispense properly through the media travel path of the printer. Also, there is a large number of installed linered media label printers which are incapable of using liner-less media labels. The present invention solves these problems and others which will become apparent upon a review of the following disclosure.

DETAILED DESCRIPTION OF THE INVENTION

Figure 1:
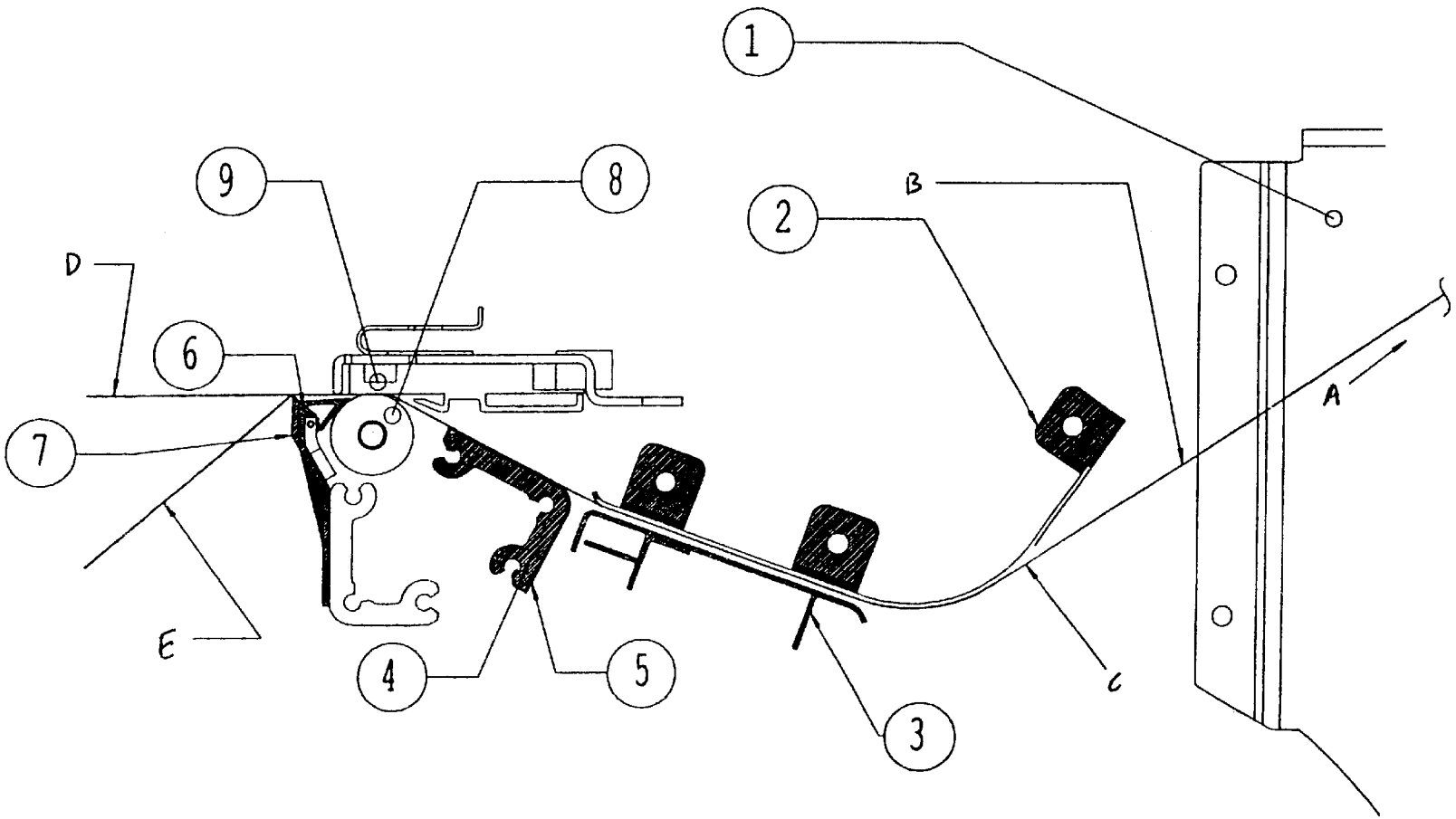
FIG. 1 is a side view of a printer media path.

A printer for linered and/or liner-less label media either purpose manufactured or retrofitted consists of powder coated non-stick media contact surfaces combined with a non-stick silicone impregnated urethane platen roller, a stainless steel tear blade and a thermal print head. FIG. 1 shows one embodiment where the media having a silicone topcoated side B and an adhesive coated side C, is routed from the media supply roll between a non-stick powder coated upper media path guide (2) and a non-stick powder coated lower media path guide (3). The media is then routed past a non-stick powder coated media path extrusion (4) then between a non-stick silicone rubber platen roller (8) and a thermal print head (9). Exiting the platen roller (8) and thermal print head (9) the printed label passes over a non-coated tear-off (7) blade that allows cutting off of a label when manual pressure on the protruding label is applied in a direction pulling the media from a position B to a position E against the tear-off blade (7). A non-stick powder coated surface is also applied to the inboard media guide plate (1) to reduce sticking and friction created by the presence of adhesive exposed on the edge of the label roll.

A specific non-sticking rubber with high friction characteristics useful as the platen roller material is "SPT-series rubber" manufactured by Silicone Products, New York, USA. In addition to powder coated non-stick coatings, "HRC-series" paints manufactured by Silicone Products, New York, USA, may also be used with similar results.

Figure 2:
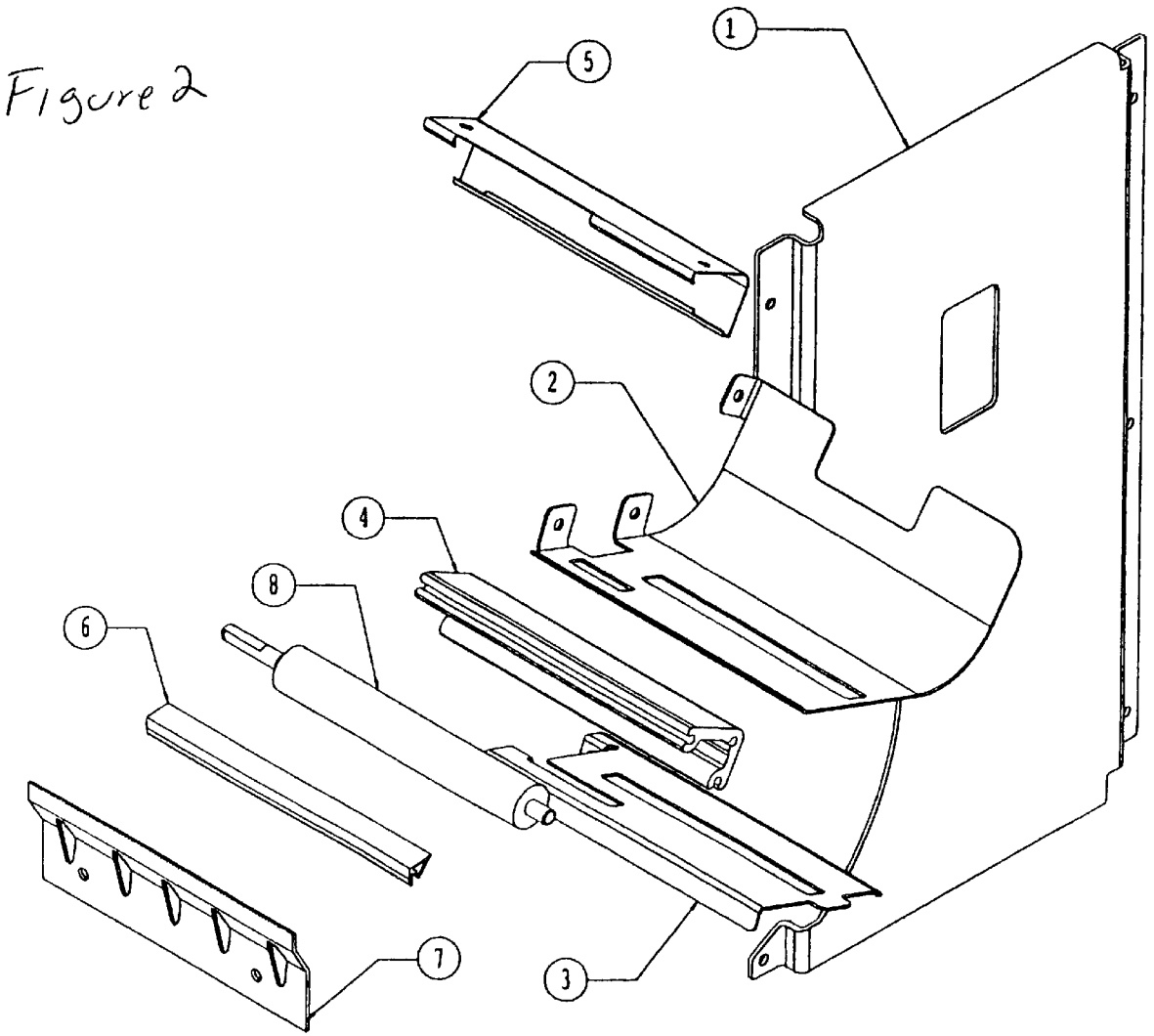
FIG. 2 is a isometric view of replacement parts used in retrofitting a printer from linered to linered/liner-less operation.

To retrofit a linered media capable label printer to linered or liner-less media label printing, the printer is disassembled in order to attach the powder coated surfaces described. However, the media path extrusion (4) may not be disassembled without losing the precise alignment of the print head (9) in the printer. To avoid alignment loss a media path extrusion cover (5) is used which is formed to snap-fit upon media path extrusion (4). The parts are shown in FIG. 2. Packaged together with installation instructions these parts form an upgrade kit allowing upgrade/conversion of a machine in the field without the need for alignment fixtures and specialized service training.

The present invention is entitled to a range of equivalents, and is limited only by the scope of the following claims.

I claim:

1. A conversion kit for converting a linered media capable printer to liner-less/linered media operation, comprising:

replacement powder coated media surfaces, a tear-off blade, a silicone impregnated platen roller, a powder coated media inboard guide plate.

2. The conversion kit of claim 1, wherein the platen roller, instead of being silicone impregnated, is SPT-series rubber.

3. The conversion kit of claim 1, wherein the media surfaces, instead of being powder coated, are painted with HRC-series paint.

4. The conversion kit of claim 1, wherein a media path extrusion is supplied with a powder coated media path extrusion cover thereby allowing retrofitting without disturbing the alignment between a print head and a media path extrusion.

* * * * *